United States Patent [19]

Hill

[11] 3,938,569

[45] Feb. 17, 1976

[54] HANDBAG

[76] Inventor: Lawrence E. Hill, 5815 Robison, Cincinnati, Ohio 45213

[22] Filed: Apr. 15, 1974

[21] Appl. No.: 460,943

[52] U.S. Cl. ..... 150/33; 5/337; 190/42

[51] Int. Cl.[2] ..... A45C 3/06

[58] Field of Search ..... 150/2.1, 2.2, 28 R, 33; 190/42, 8; 5/337, 341

[56] References Cited

UNITED STATES PATENTS

| | | | |
|---|---|---|---|
| 1,677,743 | 7/1928 | Berton | 190/42 X |
| 2,293,530 | 8/1942 | Beehler | 190/42 |
| 2,580,904 | 1/1952 | Faulkner | 5/339 |
| 2,661,785 | 12/1953 | Daust | 150/28 R |
| 2,962,731 | 12/1960 | Bounds | 5/337 |
| 3,148,389 | 9/1964 | Lustig | 5/341 X |
| 3,763,972 | 10/1973 | Karzmar | 150/2.2 X |

*Primary Examiner*—Donald F. Norton
*Attorney, Agent, or Firm*—John G. Schenk

[57] ABSTRACT

A handbag is disclosed which has particular utility for carrying personal objects therein, as well as serving as a cushion. The handbag is constructed with padding on the outside of the article carrying compartment. The padding serves to protect the articles therein when the handbag is used as a cushion.

1 Claim, 6 Drawing Figures

HANDBAG

BACKGROUND OF THE INVENTION

This invention relates generally to handbags and more particularly to a combination handbag and cushion.

There are numerous prior art devices which disclose pillows or the like and which are formed with compartments for receiving articles, such as radios, handkerchiefs, and the like. Examples of such articles are U.S. Pat. Nos. to Bounds, 2,962,731; Beehler, 2,293,530; and Ritchey, 2,618,790. In addition, it is known that there are portable cushions which include a small compartment for carrying an item such as illustrated in Faulkner, Jr., 2,580,904. None of the prior art devices, however, permits the carrying of a multitude of personal items such as is carried by most women in their purses and handbags.

Accordingly, it is an object of this invention to provide an attractive handbag which may be used as a cushion.

Another object of this invention is to provide a handbag which is simple in construction, neat in appearance and which provides ample room for carrying personal articles therein.

A further object of this invention is to provide a handbag which provides protection for the articles therein when being used as a cushion.

SUMMARY OF THE INVENTION

This invention provides a handbag for carrying personal articles and protecting such articles when the handbag is used as a cushion. Padding is secured between the lining and the outside covering of the handbag. The padding serves to protect the articles carried within the chamber defined by the lining.

Other objects, details, uses and advantages of this invention will become apparent as the following description of an exemplary embodiment thereof presented in the accompanying drawings proceeds.

BRIEF DESCRIPTION OF THE DRAWINGS

The accompanying drawings show a present exemplary embodiment of this invention in which.

DESCRIPTION OF THE ILLUSTRATED EMBODIMENT

Figure 1:
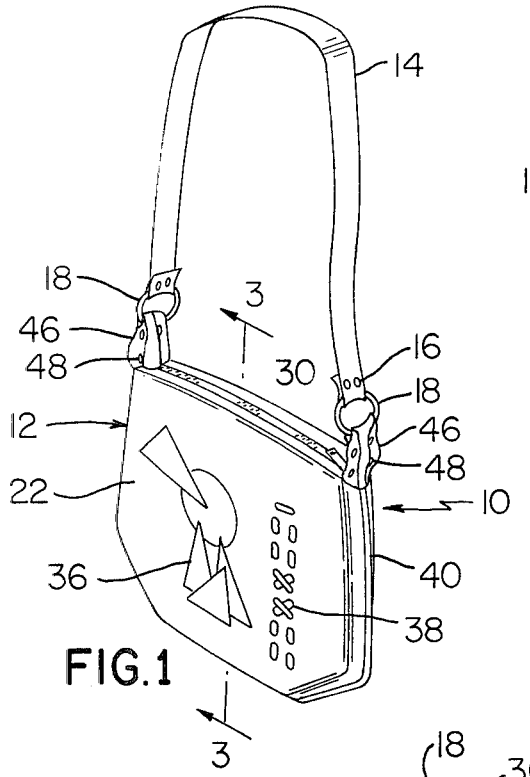
FIG. 1 is a perspective view of the handbag as typically carried.
Figure 2:
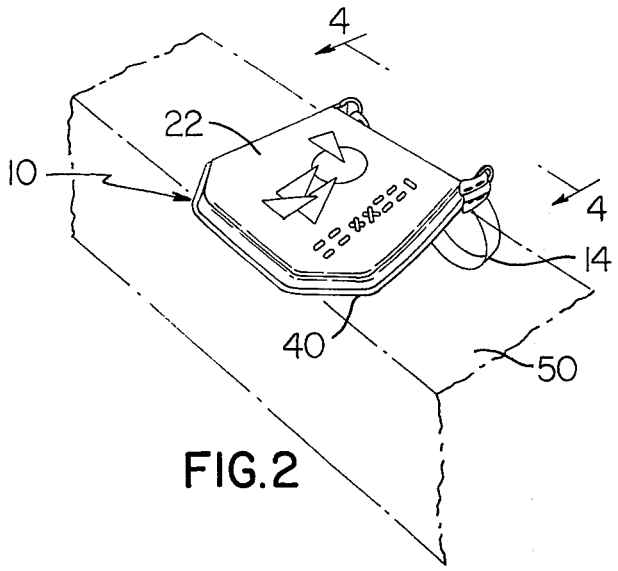
FIG. 2 is a perspective view of the handbag of FIG. 1 being used as a cushion.

Reference is now made to FIGS. 1 and 2 of the drawings, which illustrate an exemplary embodiment of the improved handbag of this invention, which is designated generally by the reference numeral 10. The handbag 10 is comprised of an article carrying member 12 to which is attached by suitable means a carrying means, such as a hand or shoulder strap 14. The strap

14 may be secured to the section 12 by any suitable means. In the present embodiment, each end of the strap 14 is secured by rivets or the like 16 on swivel rings 18. The rings 18 are secured to the section 12 in a known manner, as will be described hereinbelow.

Figure 3:
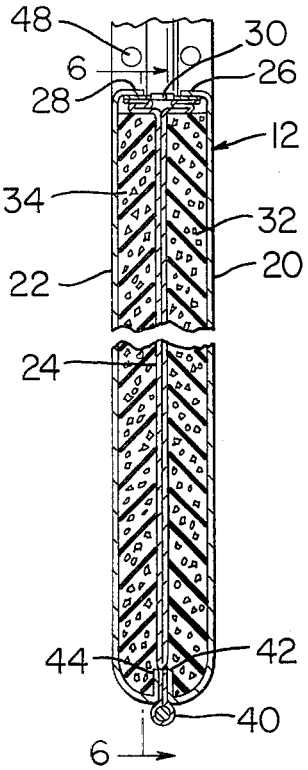
FIG. 3 is a sectional view taken along line 3—3 of FIG. 1.

Referring particularly to FIG. 3, it can be seen that the article carrying section 12 is formed with a pair of outside surfaces or covers 20 and 22. The outside covering may be made of any suitable material such as leather, plastic, heavy fabric, or the like. A liner 24 defines the article carrying chamber of the handbag 10. The liner 24 may include pockets or the like (not shown) for receiving articles such as a wallet, comb, mirror, etc., rather than having all of the articles carried merely being loose in the defined chamber. The liner is secured to the upper edges 26 and 28 of the respective covers 20 and 22 by suitable means such as sewing. In addition, closure means such as a zipper 30 is secured thereto so that the handbag 10 may be closed. It is obvious that other closure means such as snaps or hooks could also be utilized. The zipper is secured to the respective edges 26 and 28 by known means such as stitching.

In order to serve as a cushion and to protect the articles therein when the handbag is being used as a cushion, pads 32 and 34 are respectively secured, as by way of example, gluing, to the inside surfaces of covers 20 and 22. The pads 32 and 34 may be of any cushioning-type material such as foam rubber or the like.

As seen in FIGS. 1 and 2, the handbag 10 may be provided with trim or decorative designs. The trim and decorations are put on the respective covers before the padding is secured thereto. Thus, in the example given, the triangles and circular design 36 may be multicolored patches of material and either flat or padded. These designs, depending on the materials used, may be secured to the outer cover by any suitable means such as sewing, gluing, riveting, etc., depending on the material and style of the handbag. The lacing 38 may be in any desired pattern. Once the decorative designs and/or lacing is placed on the outer covering, the respective pads are secured to the inside of the cover.

Figure 5:
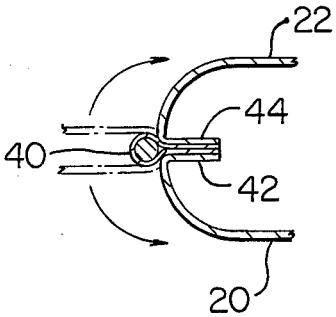
FIG. 5 is a fragmentary sectional view showing the method of securing the sides of the handbag together.
Figure 6:
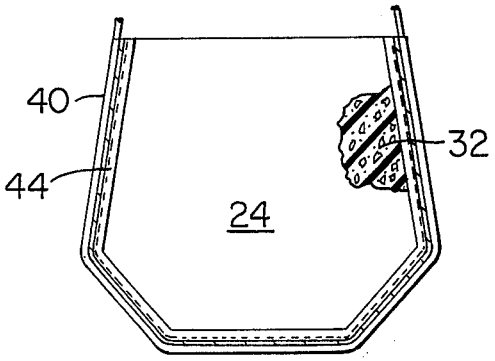
FIG. 6 is a view taken along line 6—6 of FIG. 3 with the lining partially broken away to show the padding.

As best seen in FIGS. 3 and 5, the respective outer covers 20 and 22 are provided with allowance edges 42 and 44. The allowance edges 42 and 44 are used to form the seam which is secured together by stitching or the like in order to join the respectve halves of the handbag together. Piping or cording 40 may be used to provide a finished looking seam. As seen in FIG. 5, the covers are turned inside out or inverted such that the outer surfaces of each are facing each other (as shown in phantom). The piping 40 may be inserted therein and the allowance edges 42 and 44, with the piping covering edge placed therebetween, secured by sewing or the like. When this is completed, the respective covers 20 and 22 are inverted, as shown by the arrows. The lining 24 and zipper 30 are then added as hereinbefore described.

Flaps 46 secure the rings 18 to the article carrying section 12, as seen in FIG. 1. Each of the flaps 46 is doubled over through the ring and thence secured by means such as rivets or the like 48. In this regard, the flap 46 also received an extended portion of the piping 40 and further engages an edge or corner of the section 12. The lower pair of rivets thus secure the flap 46 to the respective covers 20 and 22.

Figure 4:
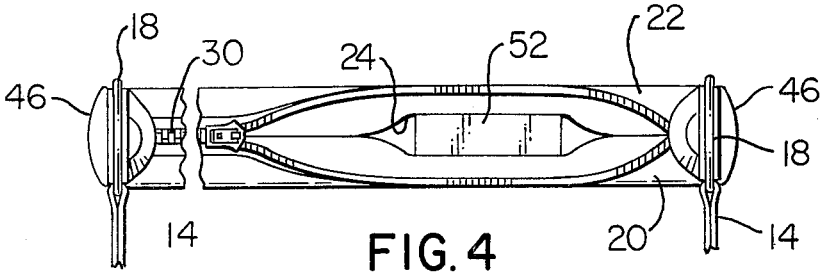
FIG. 4 is an elevational view taken along line 4—4 of FIG. 2.

As seen in FIGS. 2 and 4, the handbag 10 can be used as a cushion on any bench seat or the like 50. FIG. 4 is an elevational view of the handbag being used as a cushion. In FIG. 4 the zipper is partially open and a personal article 52 is seen to be in place between the respective sides of the handbag. The padding material between the lining 24 and the covers 20 and 22 prevents the article from being damaged.

It can be seen from the above description that Applicant has provided a new combination handbag and cushion which is neat and simple in construction, functions as a handbag and also as a cushion. Articles need not be removed from the handbag when used as a cushion due to the padding cushion. Accordingly, the objectives hereinbefore set forth have been accomplished.

While a present exemplary embodiment of this invention has been illustrated and described, it will be recognized that this invention may be otherwise variously embodied and practiced by those skilled in the art.

What is claimed is:

1. A combination handbag and cushion comprising first and second outside wear-resistant covers forming the exterior sides thereof, a one piece U-shaped liner comprising a closed lower portion and first and second side portions, said first liner side portion having its upper peripheral edge secured to the upper peripheral edge of said first outside wear-resistant cover, said second liner side portion having its upper peripheral edge secured to the upper peripheral edge of second outside wear-resistant cover, a zipper fixedly secured between the upper peripheral edges of said first and second outside wear-resistant covers to provide access to the interior of said handbag, allowance edged being provided on the remaining peripheral edges of said first and second outside wear-resistant covers, said allowance edges of said first and second outside wear-resistant covers being secured together, piping means contained within said secured allowance edges, cushioning means for protecting objects carried within said handbag from damage when the article is used as a cushion and further providing comfort for the user when seated thereon, said cushioning means comprising a first cushion pad fixedly secured to said first outer wear-resistant cover between said first outer wear resistant cover and said first liner side portion, and a second cushion pad fixedly secured to said second outer wear-resistant cover and said second liner side portion, said cushion pads covering the entire area of said outside wear-resistant covers, a level central bottom portion, substantially parallel to said upper peripheral edge, said bottom portion having upwardly and outwardly extending end portions connected with substantially vertical side edges whereby objects placed within said handbag will fall to the bottom and be directed by said upwardly outwardly extending portions toward said level central bottom portion thereby concentrating said objects in a smaller area and facilitating locating said objects by the user, and a strap secured to said device for transporting the device when used as handbag.

* * * * *